US005787723A

United States Patent [19]

Mueller et al.

[11] Patent Number: 5,787,723

[45] Date of Patent: Aug. 4, 1998

[54] REMOTE ICE MAKING MACHINE

[75] Inventors: Lee G. Mueller, Kewaunee; Howard G. Funk, Manitowoc; Timothy J. Kraus, Two Rivers; Steven P. Kutchera; Gregory McDougal, both of Manitowoc; David J. Williamson, Manitow, all of Wis.

[73] Assignee: Manitowoc Foodservice Group, Inc., Sparks, Nev.

[21] Appl. No.: 746,315

[22] Filed: Nov. 12, 1996

Related U.S. Application Data

[63] Continuation-in-part of Ser. No. 702,362, Aug. 21, 1996, abandoned.

[60] Provisional application No. 60/002,550 Aug. 21, 1995.

[51] Int. Cl.[6] ..... F25C 1/12

[52] U.S. Cl. ..... 62/347; 62/351

[58] Field of Search ..... 62/347, 351

[56] References Cited

U.S. PATENT DOCUMENTS

| | | | |
|---|---|---|---|
| 2,943,456 | 7/1960 | Lee . | |
| 3,020,730 | 2/1962 | Harris, Sr. | 62/351 |
| 3,232,064 | 2/1966 | Murphy et al. . | |
| 3,430,452 | 3/1969 | Dedricks et al. | 62/347 |
| 3,877,242 | 4/1975 | Creager . | |
| 3,964,270 | 6/1976 | Dwyer . | |
| 4,276,751 | 7/1981 | Saltzman et al. . | |
| 4,455,843 | 6/1984 | Quarles . | |
| 4,480,441 | 11/1984 | Schulze-Berge et al. . | |
| 4,489,566 | 12/1984 | Saltzman . | |
| 4,489,567 | 12/1984 | Kohl . | |
| 4,510,761 | 4/1985 | Quarles . | |
| 4,785,641 | 11/1988 | McDougal . | |
| 5,207,761 | 5/1993 | Ruff . | |
| 5,218,830 | 6/1993 | Martineau . | |
| 5,289,691 | 3/1994 | Schlosser et al. . | |
| 5,325,682 | 7/1994 | Chiang . | |
| 5,354,152 | 10/1994 | Reinhardt et al. . | |
| 5,355,697 | 10/1994 | Morimoto . | |
| 5,375,432 | 12/1994 | Cur . | |
| 5,431,027 | 7/1995 | Carpenter . | |
| 5,460,007 | 10/1995 | Reed et al. . | |
| 5,477,694 | 12/1995 | Black et al. . | |

OTHER PUBLICATIONS

*Air Conditioning, Heating & Refrigeration News*, Nov. 27, 1995, p. 16.

Product sheet entitled, "Vogt® Tube–Ice® Machines Hels (High Efficiency Lowside)", one page, Jul. 11, 1995.

Brochure entitled, "Iceflo Systems", 8 pages, published by McCann's Engineering & Mfg. Co., 1995.

*Primary Examiner*—William E. Tapolcai

*Attorney, Agent, or Firm*—Steven P. Shurtz; Brinks Hofer Gilson & Lione

[57] ABSTRACT

A remote ice-making machine is disclosed having a compressor unit remote from an evaporator unit, a supply line for transferring refrigerant from the compressor unit to the remote evaporator unit, and a return line for returning refrigerant from the evaporator unit to the compressor unit during an ice-making mode. The preferred evaporator unit has an ice-forming evaporator and a heating unit, as well as a valve for controlling the flow of refrigerant into the evaporator unit. A method for making ice with the remote ice-making unit is also disclosed.

28 Claims, 5 Drawing Sheets

REMOTE ICE MAKING MACHINE

CROSS REFERENCE TO RELATED APPLICATION

The present application is a continuation-in-part of a U.S. patent application Ser. No. 08/702,362, filed Aug. 21, 1996, now abandoned, which claims the benefit of the filing date under 35 U.S.C. §119(e) of provisional U.S. Patent Application Ser. No. 60/002,550, filed Aug. 21, 1995, both of which are hereby incorporated by reference.

BACKGROUND OF THE INVENTION

The present invention relates to automatic ice making machines, and more particularly to automatic ice making machines where the evaporator unit is located at a remote location from the compressor unit.

Automatic ice-making machines rely on refrigeration principles well-known in the art. During an ice making stage, the machines transfer refrigerant from the compressor unit to the evaporator unit to chill the evaporator and an ice-forming evaporator plate below freezing. Water is then run over or sprayed onto the ice-forming evaporator plate to form ice. Once the ice has fully formed, a sensor switches the machine from an ice production mode to an ice harvesting mode. During harvesting, the evaporator must be warmed slightly so that the frozen ice will slightly thaw and fall off of the evaporator plate into an ice collection bin. To accomplish this, hot refrigerant gas is routed from the compressor straight to the evaporator, bypassing the condenser.

In a typical automatic ice-making machine, the compressor unit generates a large amount of heat and noise. One of the primary advantages of a remote system is that the compressor unit may be located outdoors or in a location where the heat and noise will not be a nuisance, while the evaporator unit may be located indoors at the point where the ice is needed. This arrangement allows for the evaporator units to be placed in areas where a hot and noisy compressor previously made ice makers inconvenient or too bulky. Another advantage is that the evaporator unit by itself is smaller than a combined evaporator and compressor. Thus the evaporator unit can be located in a more compact area than an entire ice machine.

Several machines have been designed in an attempt to overcome the problem of heat and noise generated by the compressor and the condenser. In normal "remote" ice-making machines, the condenser is located at a remote location from the evaporator unit and the compressor. This allows the condenser to be located outside or in an area where the large amount of heat it generates would not be a problem. However, the compressor remains close to the evaporator unit so that it can provide the hot gas used to harvest the ice. While this machine solves the problem of heat generated by the condenser, it does not solve the problem of the noise and bulk created by the compressor.

Other machine designs place both the compressor and the condenser at a remote location. These machines have the advantage of removing both the heat and noise of the compressor and condenser to a location removed from the ice making evaporator unit. However, the compressor's distance from the evaporator unit causes inefficiency during the harvest cycle. During this cycle, hot gas from the compressor is piped directly to the evaporator unit from the compressor. Because of the length of the refrigerant lines connecting the two units in such a remote system, the hot refrigerant gas loses much of its heat before reaching the evaporator unit. This results in an increased defrost time and inefficient performance.

U.S. Pat. No. 4,276,751 to Saltzman et al. describes a compressor unit connected to one or more remote evaporator units with the use of three refrigerant lines. The first line delivers refrigerant from the compressor unit to the evaporator units, the second delivers hot gas from the compressor straight to the evaporator during the harvest mode, and the third is a common return line to carry the refrigerant back from the evaporator to the compressor. The device disclosed in the Saltzman patent has a single pressure sensor that monitors the input pressure of the refrigerant entering the evaporator units. When the pressure drops below a certain point, which is supposed to indicate that the ice has fully formed, the machine switches from an ice-making mode to a harvest mode. Hot gas is then piped from the compressor to the evaporator units. Every evaporator unit in the Saltzman device is fed by the same three common lines from the compressor unit. Whenever the compressor is piping refrigerant to one evaporator unit, it is piping refrigerant to all of the other evaporator units as well. The same is true of the hot gas in the harvest mode. Because of this, all evaporator units must be operating in the same mode. It is not possible for one evaporator unit to be in an ice-making mode while another is in a harvest mode.

U.S. Pat. No. 5,218,830 to Martineau also describes a remote ice making system. The Martineau device has a compressor unit connected to one or more remote evaporator units through two refrigerant lines, a supply line and a return line. During an ice-making mode, refrigerant passes from the compressor to the condenser, then through the supply line to the evaporator. The refrigerant vaporizes in the evaporator and returns to the compressor through the return line. During the harvest mode, a series of valves redirects hot, high pressure gas from the compressor through the return line straight to the evaporator to warm it. The cold temperature of the evaporator converts the hot gas into a liquid. The liquid refrigerant exits the evaporator and passes through a solenoid valve and an expansion device to the condenser. As the refrigerant passes through the expansion device and the condenser it vaporizes into a gas. The gaseous refrigerant then exits the condenser and returns to the compressor. As with the Saltzman et. al. patent, all evaporator units are fed by a common set of lines from the compressor unit. Thus, all evaporator units must be running in the same ice-making or harvest mode simultaneously.

One of the main drawbacks of these prior systems is that the long length of the refrigerant lines needed for remote operation causes inefficiency during the harvest mode. This is because the hot gas used to warm the evaporator must travel the length of the refrigeration lines from the compressor to the evaporator. As it travels, the hot gas loses much of its heat to the lines' surrounding environment. This results in a longer and more inefficient harvest cycle. In addition, at long distances the loss may become so great that the hot gas discharge fails to function properly at all.

Another drawback is that all of the evaporator units must be operating in the same mode simultaneously. The prior systems are limited by the use of the refrigerant lines both to circulate refrigerant in the ice-making mode and to transfer hot gas in the harvest mode. Therefore, both modes cannot be active at the same time.

All evaporator units on the prior systems must enter harvest mode simultaneously as they require the hot gas discharge from the compressor. Evaporator units may form ice at different rates due to varying thermal characteristics.

These thermodynamic characteristics will be affected by such factors as the ambient temperature of the room in which the evaporator is located, the length of the refrigerant lines from the compressor unit to the evaporator unit, and the size and efficiency of the particular evaporator unit. Forcing all of the evaporator units to enter a harvest mode at the same time may start the harvest mode too early on some evaporator units, resulting in incompletely formed ice, and too late on others, which would decrease the production volume and energy efficiency of the system.

SUMMARY OF THE INVENTION

It is with the above considerations in mind that the present remote ice making machine has been invented.

In one aspect, the invention is an ice-making unit with a compressor unit and a remote evaporator unit. The compressor unit contains at least one compressor and at least one condenser, as well as interconnecting lines. The remote evaporator unit has at least one ice-forming evaporator and at least one heating unit in thermal contact with the ice-forming evaporator. The remote evaporator unit also has at least one fresh water inlet, at least one water reservoir, at least one water circulation mechanism, and interconnecting lines for connecting the various components. The remote ice making machine also has a supply line connecting the compressor unit to the remote evaporator unit which supplies a refrigerant from the compressor unit to the remote evaporator unit during an ice-making mode, and a return line connecting the remote evaporator unit to the compressor unit which returns the refrigerant from the remote evaporator unit to the compressor unit during the ice-making mode.

In a second aspect, the invention is a method of making ice using an ice-making machine comprising the steps of passing a refrigerant from a compressor unit through a supply line to a remote evaporator unit, thus cooling an ice-forming evaporator to freeze water into ice, and returning the refrigerant from the remote evaporator unit back to the compressor unit through a return line. The method of making ice further has the steps of stopping the circulation of the refrigerant between the compressor unit and the remote evaporator unit with a valve during a harvest mode, and activating a heating unit in thermal contact with the ice-forming evaporator during the harvest mode to release the ice from the ice-forming evaporator.

In a third aspect, the invention is an evaporator unit comprising at least one ice-forming evaporator, at least one heating unit in thermal contact with the ice-forming evaporator, at least one fresh water inlet, at least one water reservoir, at least one water circulation mechanism, and water lines for interconnecting the various components. In addition, the evaporator unit has a regulatory valve that allows a refrigerant to circulate through the evaporator unit during an ice-making mode and prevents the refrigerant from circulating through the evaporator unit during a harvest mode.

In the preferred embodiment, each evaporator unit has a separate heating unit to be used in the harvest mode. By designing each evaporator unit with its own heating unit, the evaporator units no longer require hot gas from the compressor during harvest mode. The remote ice-making machine will therefore not be hampered by the thermal losses prior art devices suffer as hot gas is piped from the compressor unit to the evaporator units. This will increase the efficiency of the harvest mode compared to prior art remote ice making equipment, as well as allow the compressor unit to be located much further away from the evaporator unit.

A further advantage of the preferred embodiment is that each evaporator unit can enter a harvest mode independently while the compressor continues to circulate refrigerant and cool the other evaporator units. This is because each evaporator unit has an individual heating unit and is not tied to a hot gas discharge from the compressor. An ice making unit with more than one evaporator unit can therefore run in both an ice-making mode and a harvest mode simultaneously.

In addition, the heating unit in each evaporator unit allows the evaporator units to be connected to a pre-existing compressor. This would be useful if a building already contained a large central compressor that fed refrigerant to several refrigeration devices, such as rack coolers. Because there is no need to be connected to a compressor that alternates circulating refrigerant and hot gas, the evaporator units could be tied directly into the pre-existing compressor's refrigeration lines. This would allow for the installation of a point-of-use ice making machine without the need for, or the bulk, noise, and heat generated by, an additional compressor and condenser.

By using the above stated methods, the remote ice making machine will realize increased productivity and efficiency. All evaporator units will be able to run independently of the others, maximizing the overall efficiency. The system will be much more flexible as multiple evaporators with largely varying thermal characteristics may all be used with a single compressor unit. In addition, the evaporator units may be installed with a new compressor unit or utilize a pre-existing compressor.

DETAILED DESCRIPTION THE DRAWINGS AND THE PREFERRED EMBODIMENTS OF THE INVENTION

Figure 1:
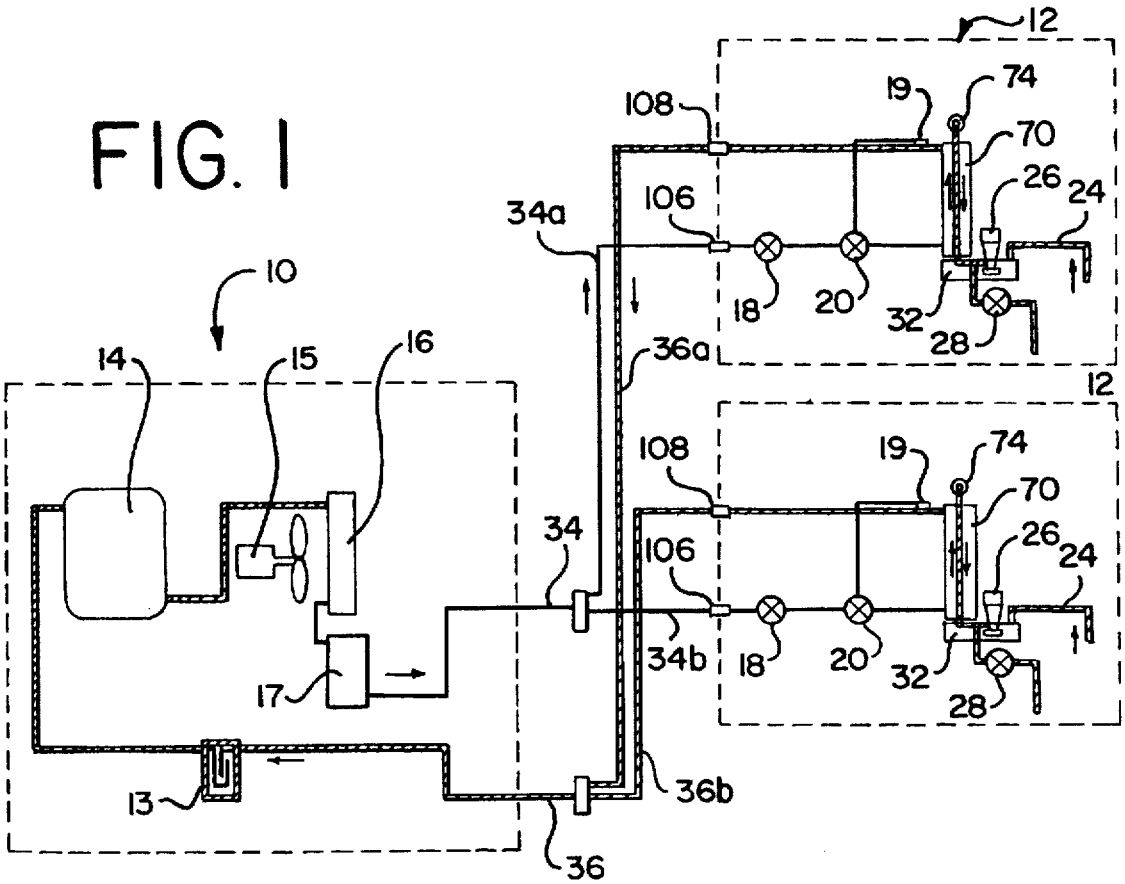
FIG. 1 is a schematic drawing of a preferred embodiment of the remote ice making machine of the present invention comprising a single compressor unit and two remote evaporator units.

An embodiment of the remote ice making unit of the present invention with a single compressor unit 10 and two remote evaporator units 12 is depicted in FIG. 1. A remote ice making unit, as used herein, means a system in which the compressor and condenser are remote from the evaporator. A remote ice making unit will comprise at least one compressor and one or more evaporators. The evaporators will generally be in a separate cabinet spaced from the compressor and condenser, which may or may not be housed in a cabinet. Usually the evaporator and compressor will be in separate rooms or otherwise separated by a wall. Typically they will be spaced so that the refrigerant lines between them will have a length greater than about four feet, more typically the length of the refrigerant lines will be more than 20 feet and often the length of the refrigerant lines between the compressor and the evaporator will be 50 feet or more.

In FIG. 1, the preferred compressor unit 10 comprises a compressor 14 and a condenser 16. The condenser can be either liquid or air cooled. A fan 15 is depicted in FIG. 1, illustrating an air cooled system. Preferably the compressor unit also includes a receiver 17 and an accumulator 18, which are commonly used in ice machines.

In FIG. 1, the preferred evaporator units 12 each comprise a regulatory valve 18, a thermal expansion valve 20, an ice-forming evaporator 70, a fresh water inlet 24, a water reservoir 32, a water circulation mechanism 26, and a water drain valve 28. In the preferred embodiments of the ice-forming evaporator, depicted in FIGS. 3 and 4, the ice-forming evaporator 70 comprises an evaporator coil 38 on the back of an ice-forming evaporator plate 22, with dividers 23 on the front surface of ice-forming evaporator plate 22 which form cubed ice.

Connecting the compressor unit and the remote evaporator units are two refrigerant lines, supply line 34 and return line 36. Each of these lines branch into two separate lines. Supply lines **34*a* and 34*b* supply refrigerant to the two evaporator units 12, while separate return lines 36*a* and 36*b* return the refrigerant. The refrigerant system may also contain a refrigerant drier, not shown. The compressor 14, condenser 16** and other components of the refrigerant system are well known and thus not further described.

The refrigerant system is charged with an appropriate refrigerant, generally a hydro-fluorocarbon, fluorocarbon or a chloro-fluorocarbon. Hydro-chloro-fluorocarbons and other halogenated hydrocarbons may also be used as a suitable refrigerant. To begin the ice-making cycle, a low pressure gaseous refrigerant is fed into the compressor 14. Compressor 14 compresses the refrigerant into a high pressure, high temperature gas. The refrigerant gas then passes to condenser 16, where it releases heat into condenser 16 and the surrounding environment. This condenses the refrigerant from a gas into a liquid. Condenser 16 is typically forced air or water cooled to help dissipate heat and increase efficiency.

The liquid refrigerant passes from condenser 16 through supply line 34 and the open regulatory valve 18, which is preferably a solenoid operated liquid refrigerant valve, to the thermal expansion valve 20 and evaporator coil 38. In evaporator coil 38, the liquid refrigerant vaporizes. As the refrigerant changes states from a liquid to a gas, it absorbs heat from evaporator coil 38 and any objects in contact with evaporator coil 38, such as ice-forming evaporator plate 22. This process chills evaporator coil 38, ice-forming evaporator plate 22 and dividers 23 to temperatures low enough that ice may be formed on them.

Once evaporator coil 38 has reached a low temperature, it may not be able to give off enough heat to vaporize all of the liquid refrigerant passing through it. If this were to happen, the refrigerant would leave evaporator coil 38 in a partially liquid, rather than a completely gaseous, state. Liquid refrigerant would then return to, and possibly damage, compressor 14. Thermal expansion valve 20 corrects this problem by regulating the amount of refrigerant entering the ice-forming evaporator 70. A temperature probe 19 connected to thermal expansion valve 20 connects to the output line of evaporator coil 38 and monitors the refrigerant temperature. If the temperature becomes too low, this indicates that the refrigerant is not being completely vaporized. The temperature probe then slightly closes the passageway through thermal expansion valve 20, which causes less refrigerant to be allowed into evaporator coil 38. Thermal expansion valve 20 will continue to close and reduce the amount of refrigerant entering evaporator coil 38 until all of the refrigerant leaving evaporator coil 38 is in a gaseous state.

After leaving evaporator coil 38, the refrigerant is in a low pressure, vaporous state. The refrigerant passes from evaporator coil 38 through the return line 36 to the compressor 14 where the process begins again.

The water/ice system normally comprises a water supply or water source, a water reservoir or sump, a mechanism for distributing the water across a cold evaporator plate to form ice, and a drainage system for expelling the unfrozen waste water.

In FIG. 1, fresh water enters the ice maker through fresh water inlet 24, typically controlled by a float valve. The water fills water reservoir 32. Once the reservoir is filled, water circulation mechanism 26 transfers water from water reservoir 32 to water distributor 74, where it is distributed evenly across the face of ice-forming evaporator plate 22. In a preferred embodiment, the water circulation mechanism is comprised of a water pump 26. Ice-forming evaporator plate 22 may have either a planar face, in which case the ice will form in sheets, or preferably the face may be shaped into recessed regions with horizontal and vertical fins or dividers 23 to form a grid for the formation of individual ice cubes. The face may also be shaped such that the ice forms in substantially individual pieces, with a thin ice bridge connecting pieces into a single sheet. This ice bridge will break easily when the ice is harvested, resulting in individual cubes.

The water flows down ice-forming evaporator plate 22. Because of the freezing temperature of the plate, some of the water will freeze and stick to the plate and dividers 23 as ice. The water which does not freeze will be collected by water reservoir 32 and recirculated across the plate. The water which does freeze will be more pure than the water which runs off, as pure water has a higher freezing temperature.

Once the ice forming on the surface of ice-forming evaporator plate 22 has reached a certain thickness, an ice sensor will be triggered. This ends the ice-making mode and starts the harvest mode.

HARVEST MODE

Figure 4:
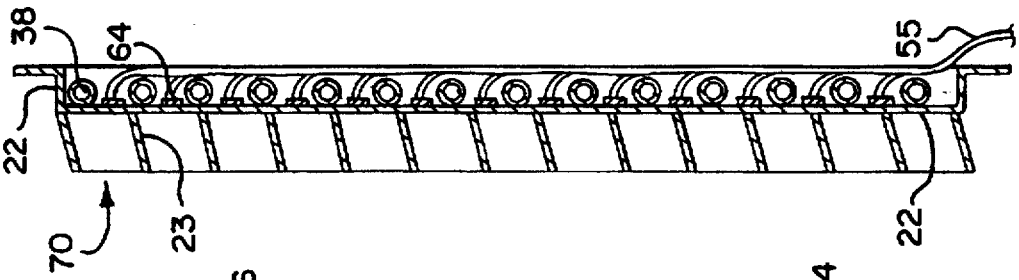
FIG. 4 is a cross-sectional view taken along line 4—4 of FIG. 3.
Figure 3:
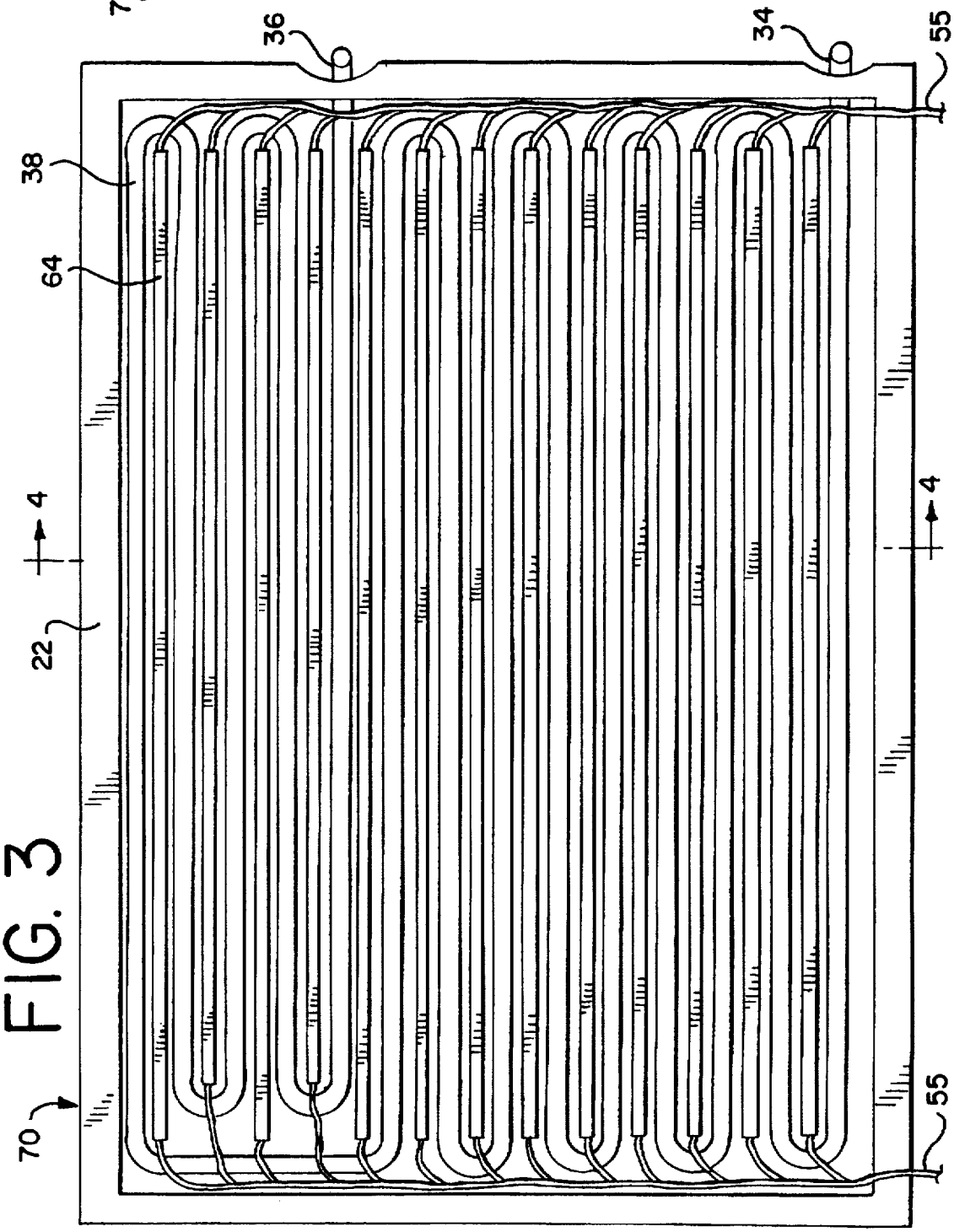
FIG. 3 is a rear elevational view of one embodiment of the evaporator coil, ice-forming evaporator plate and the heating unit, where the heating unit is comprised of electric heating strips situated between sections of the evaporator coil.

Once ice has fully formed on ice-forming evaporator plate 22, the evaporator plate must be warmed to slightly melt the ice so that it may be removed. First, regulatory valve 18 is closed. This prevents refrigerant from entering into the evaporator unit and further cooling it. After regulatory valve 18 closes, the compressor will continue to operate and remove any refrigerant remaining in the evaporator unit through return line 36. A heating unit in thermal contact with ice-forming evaporator plate 22 is next activated. The heating unit may be designed in several different ways. A typical embodiment is depicted in FIGS. 3 and 4, where the heating unit comprises electric heating strips 64 connected in parallel by wires 55 to an electrical current source. The heating stripes 64 are mounted directly on the back of ice-forming evaporator plate 22 between serpentine sections of evaporator coil 38. Preferred heating strips 64 are from Minco, Minneapolis, Minn. Preferably 0.14×8.30 inch silicon rubber heaters with 61 ohms of resistance are used. Preferably 13 such heaters are mounted on the back of an evaporator plate about 12 inches high and 17 inches wide.

The heating unit warms evaporator coil 38 and ice-forming evaporator plate 22, slightly melting the ice and allowing it to fall off of the plate into an ice collection bin (not shown). In the preferred embodiment, the falling ice will activate a switch, known as a bin switch, terminating the harvest cycle. This will shut off the heating unit and open liquid solenoid valve 18 so that the ice-making mode can begin again. Preferably a thermal cutoff switch is also connected to the heating unit. The cutoff switch will deactivate the heating unit if the heating unit reaches a preset temperature. This is a safety feature used to shut off the heating unit should the bin switch become stuck or malfunction.

CONTROL SYSTEM

Figure 2:
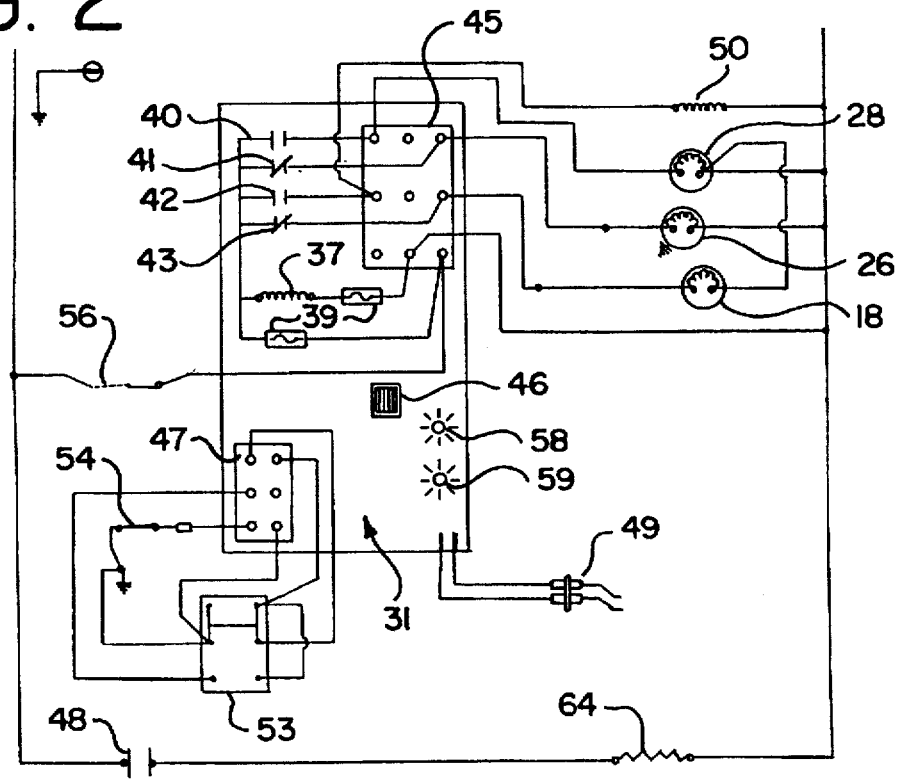
FIG. 2 is a schematic drawing of the relevant portions of the electrical circuitry used to control one of the remote evaporator units depicted in FIG. 1.

The control systems for the compressor and condenser are typical of the controls currently found in the art of automatic ice making machines and therefore need not be discussed. The electrical control system for the evaporator unit, with contacts closed as during a freeze cycle, is depicted in FIG. 2. Some of the electrical components are preferably mounted on a control board 31. The control board includes a transformer 38, two fuses 39, four relays 40, 41, 42 and 43, jacks for leads to an ice sensor assembly 49, two lights 58 and 59 and several multi-pin plug connections 45, 46 and 47. The transformer 38 provides a low voltage current to the ice sensor assembly 49 mounted on the evaporator plate. The assembly sends back a different signal depending on whether or not it senses water flowing over ice. When the ice is not yet frozen to a desired thickness, one signal is sent. When the ice has grown to the desired, predetermined thickness and water flows over it and contacts probes in the assembly, another signal is sent. Depending on the signal, relays 41 and 43 are closed and relays 40 and 42 are open, as shown in FIG. 2, or the relays 40 and 42 are closed and relays 41 and 43 are open.

As the ice-making mode begins, ice sensor assembly 49 provides a signal which closes relays 41 and 43. This opens normally closed liquid solenoid or regulatory valve 18, allowing refrigerant to flow through the thermal expansion valve 20 to evaporator coil 38, and energizes water pump 26. Alternatively, relay 43 could energize a pump relay coil (not shown), which closes a pump relay contact (not shown) and begins a pump delay timer (not shown). The pump delay timer is used when it is desired to wait a set amount of time, such as thirty seconds, for evaporator coil 38 and ice-forming evaporator plate 22 to precool before the water pump 26 starts sending water over the evaporator plate 22. Water pump 26 circulates water through water distributor 74 and onto ice-forming evaporator plate 22, where it freezes to form ice.

After the ice has grown to a preset thickness, the ice sensor assembly 49 sends a signal indicating that a harvest cycle should begin. Preferably after seven seconds of continuous contact with water flowing over the ice and contacting its probes, ice sensor assembly 49 opens relay 43, which will close regulatory valve 18 to prevent any further refrigerant from entering and cooling the evaporator unit. At the same time, relay 42 is closed, which will energize coil 50, causing heater contactor 48 to close. Heating contactor 48 activates the heating unit, such as heating strips 64, to warm the ice-forming evaporator plate. Relay 40 is also activated, which causes water drain valve 28 to open. This allows the remaining water in the water reservoir 32 to be expelled through water drain valve 28.

Harvest mode is ended when the ice falls off of ice-forming evaporator plate 22 and opens bin switch 54 or activates some other form of sensor. Should bin switch 54 fail to open, thermal cutoff switch 54 will terminate the harvest mode when the heating unit reaches a predetermined temperature, such as 75° F., or more preferably 100° F. When the ice bin is full, bin switch 56 will remain open and the ice making machine will go into standby mode. Regulatory valve 18 will remain closed and the heating unit will be deactivated. No further ice will be made in standby mode. Once ice has been removed from the bin through use or melting, bin switch 54 will close and the machine will enter the ice-making mode again.

The control system preferably also includes a three position low voltage toggle switch 53 so that the evaporator unit can be turned to an "off" or a "clean" position, as well as an ice making position. Multi plug connector 46 is preferably designed so that an automatic cleaning system, such as disclosed in U.S. Pat. No. 5,289,691, can be connected to the evaporator unit 12. Light 58 is preferably used to indicate that the evaporator unit is in a harvest mode or some safety limit has been triggered. Light 59 is preferably used to indicate that bin switch 54 is open and hence the ice bin is full.

In prototype machines, it may be desirable to include a control (not shown) in line with heater strips 64 to manually vary the current supplied to heater strips 64 when heater contactor 48 is closed. Alternatively, the control may be tied to a temperature sensor, such as the sensor which controls thermal cutoff switch 56, and as the temperature of the ice-forming evaporator plate 22 nears 32° F., the amount of current supplied to the heater strips 64 by the control could be reduced so that evaporator plate 22 is not heated more than necessary.

ALTERNATIVE EMBODIMENTS

Figure 6:
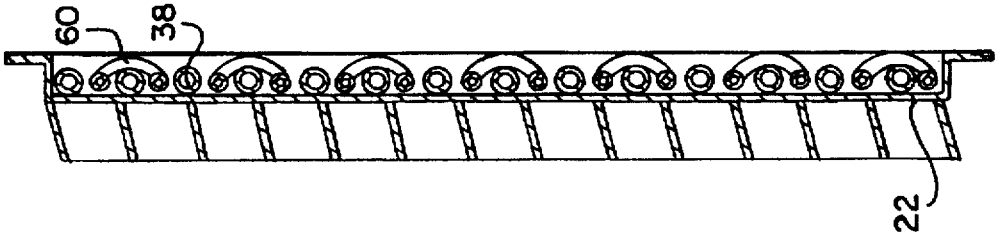
FIG. 6 is a cross-sectional view taken along line 6—6 of FIG. 5.
Figure 5:
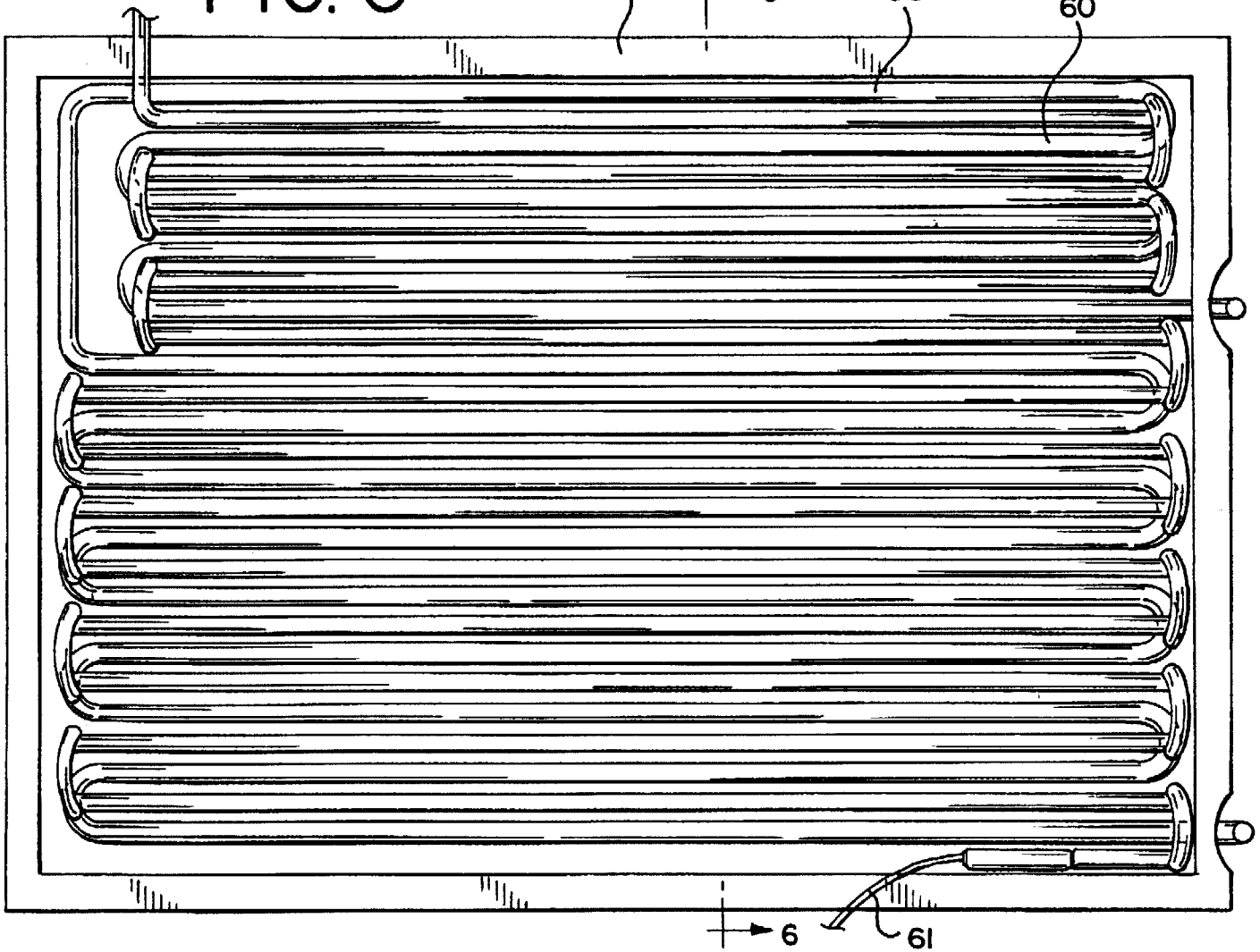
FIG. 5 is a rear elevational view of an alternative embodiment of the evaporator coil, ice-forming evaporator plate and the heating unit, where the heating unit is comprised of a serpentine electric heating tube placed between sections of the evaporator coil.
Figure 8:
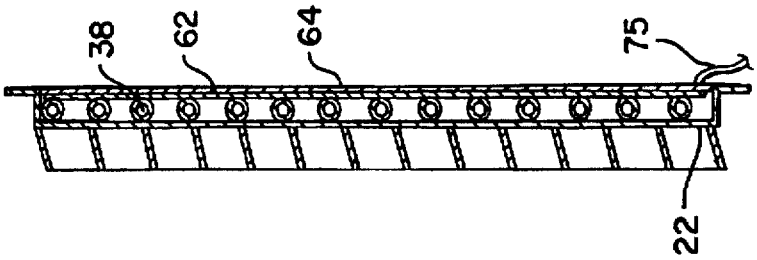
FIG. 8 is a cross-sectional view taken along line 8—8 of FIG. 7.
Figure 9:
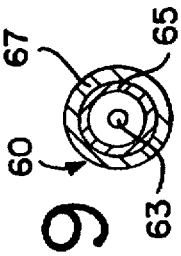
FIG. 9 is an enlarged cross-sectional view of the electric heating tube of FIG. 6.

FIGS. 5–10 show alternative embodiments of the heating unit. The evaporator plate 22 and evaporator coil 38 are the same in these embodiments as for the embodiments of FIGS. 1–4. In FIGS. 5 and 6, the heating unit is comprised of an electric tubular heater 60 situated between serpentine sections of evaporator coil 38. Electric tubular heater 60 is in thermal contact with ice-forming evaporator plate 22. During harvest mode, an electric current passes through wire 61 to electric tubular heater 60, heating it and ice-forming evaporator plate 22 to remove the ice formed on ice-forming evaporator plate 22. The tubular heater 60 is preferably a calrod heat tube which includes a central wire 63 embedded in magnesium oxide 65 surrounded by a tubular covering 67 (FIG. 9). A presently preferred calrod tube is a 0.315 inch diameter, 2200 watt heater custom built by TruHeat, Allegan, Mich. It is believed that a wattage between 1000 and 2000 watts will be sufficient in the final design.

Figure 7:
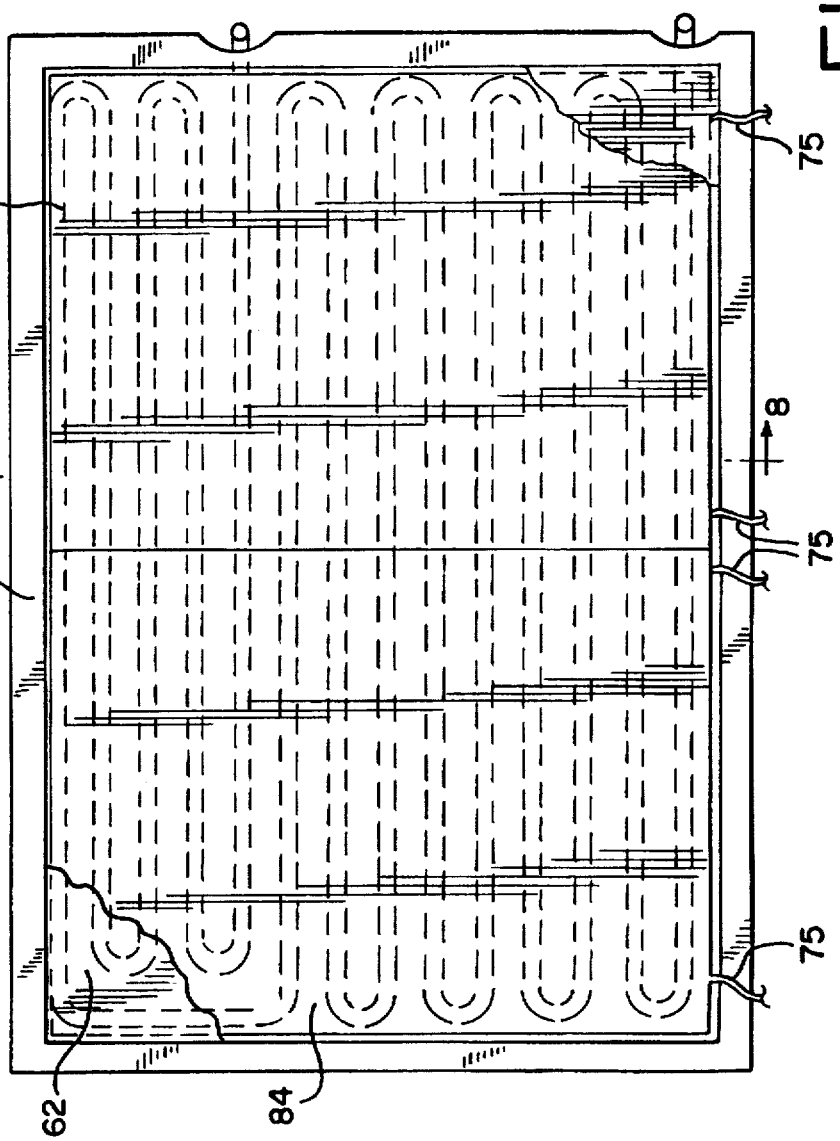
FIG. 7 is a rear elevational view of another alternative embodiment of the evaporator coil, ice-forming evaporator plate and the heating unit, where the heating unit is comprised of a heating pad mounted behind the evaporator coil.

FIGS. 7 and 8 show another embodiment of the heating unit. Two electric heating pads 62 are sandwiched between evaporator coil 38 and a heating pad plate 84. Each heating pad 62 comprises at least one electric heating coil in a thermally conductive layer covering at least a portion of the evaporator coil 38. During the harvest mode, current is supplied through wires 75. Resistance in electric heating pads 62 causes heating of the electric heating pads 62, evaporator coil 38 and ice-forming evaporator plate 22. An advantage of this embodiment is that electric heating pads 62 are mounted on heating pad plate 84 and may be easily removed for repair or replacement. A preferred heating pad 62 is available from Minco, Minneapolis, Minn. that is 4 inches by 16.8 inches and 50.1 ohms. Three pads would be used on a twelve inch by seventeen inch evaporator.

Figure 10:
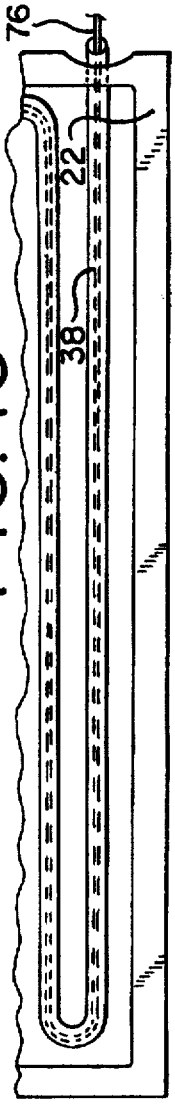
FIG. 10 is a rear elevational view similar to FIGS. 3, 5, and 7 of another alternative embodiment of the evaporator coil, ice-forming evaporator plate and the heating unit, where the heating unit is comprised of a resistive electric heating wire located inside of the evaporator coil.

FIG. 10 shows another embodiment of the heating unit. Electric heating wire 76 is threaded through the inside of evaporator coil 38. During the harvest mode, an electric current heats electric heating wire 76. This warms evaporator coil 38 and thermally connected ice-forming evaporator plate 22 so that the ice may be removed.

Figure 11:
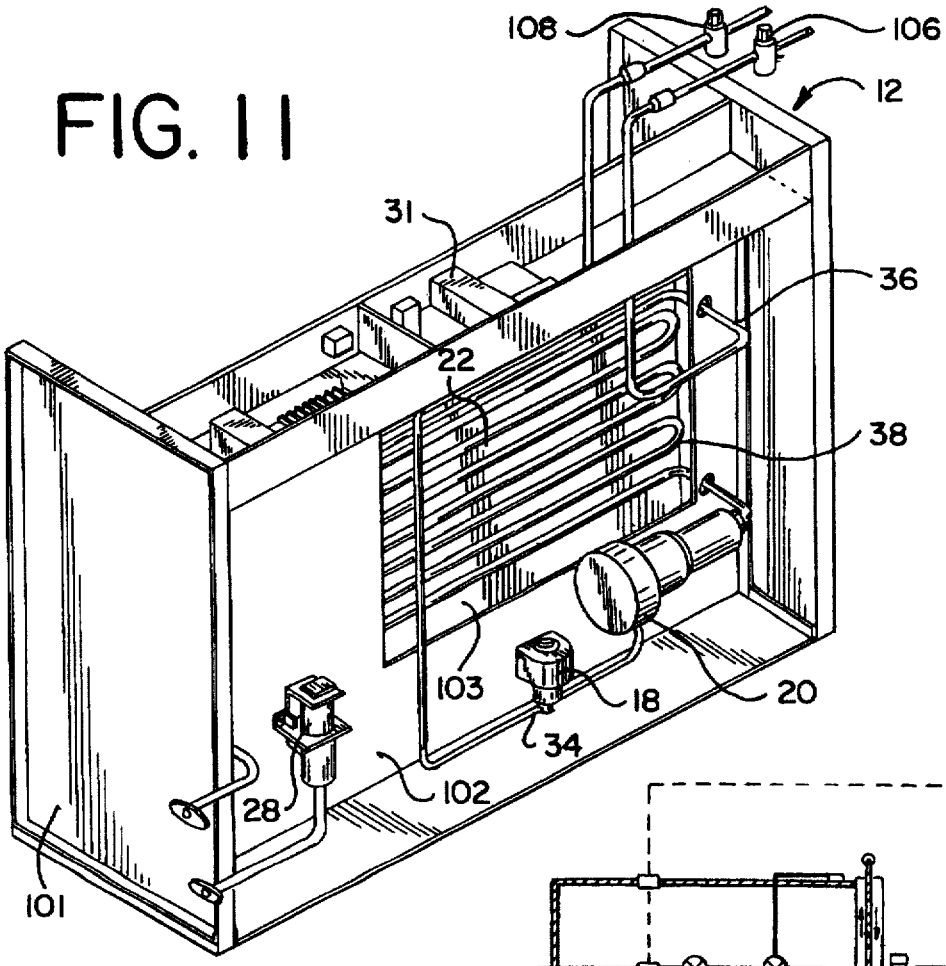
FIG. 11 is a rear perspective view of a preferred remote evaporator unit of the present invention.

FIG. 11 shows a preferred method of mounting the evaporator plate 22 with evaporator coil 38 inside of an evaporator unit 12. It is desirable to have access to the heating unit without having to remove the evaporator plate 22 from its housing 101. Thus, in the embodiment of FIG. 11, a cut out area 103 is provided in the bulkhead 102 area of the housing 101, directly behind the evaporator plate 22. Normally a cover (not shown) will be placed over the cut out area 103 to seal the bulkhead 102. However, if access is desired, for example to replace a defective heating unit, the cover may be removed and access gained to the heating unit without dismantling the evaporator unit 12. Although not shown, preferably insulation is placed over the bulkhead 102 and cover on the side opposite the evaporator plate 22. This insulation prevents the back side of the bulkhead from sweating. An air gap is provided between the heating unit and the bulkhead cover. The air gap acts as an insulator during the harvest mode when the heating unit warms the evaporator plate 22.

FIG. 11 also shows the preferred placement of a number of the components shown schematically in the earlier figures, such as liquid solenoid valve 18, thermal expansion valve 20, water drain valve 28, and control board 31.

In the preferred embodiment, the refrigerant lines 34 and 36 will include refrigeration service valves 106 and 108 (FIGS. 1 and 11) such as angle valve part no. 91143 or no. 91145 from Pimore, Inc., Adrian Mich. Alternatively, self sealing couplings such as Aeroquip Air Conditioning and Refrigeration 5500 Series Self-Sealing Couplings, from Aeroquip Industrial Amerigas Group, New Haven, Ind. could be used. Such self sealing couplings would allow the evaporator unit 12 to be disconnected from the compressor unit 10 for servicing without loss of refrigerant, as well as precharging of the individual components during manufacture for easier assembly at the installation site. One portion of the coupling would be mounted on top of the evaporator housing 101 and the other half of the coupling would be on the evaporator end of supply and return lines 34 and 36. If self sealing couplings are used, it would be preferable to include a refrigerant line test or sampling valve in the evaporator unit. The refrigerant service valves include such test access capability.

Figure 12:
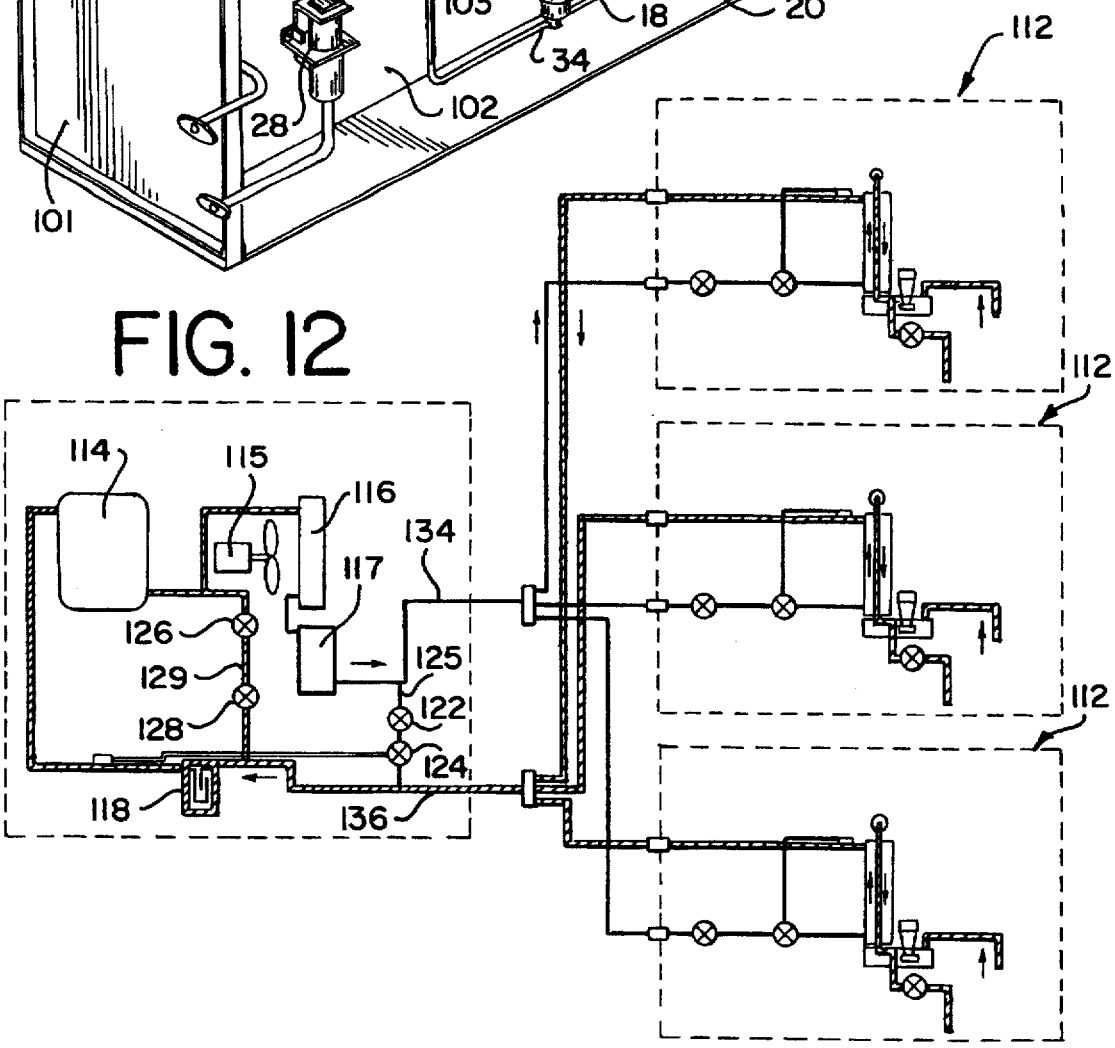
FIG. 12 is a schematic drawing of a second preferred embodiment of a remote ice-making machine of the present invention comprising a single compressor unit with a bypass system and three remote evaporator units.

FIG. 12 shows a schematic of a second embodiment of the invention. In this embodiment, there are three evaporator units 112 rather than two, as shown in FIG. 1. The evaporator units 112 include the same components as evaporator units 12 described earlier. The compressor unit 110, while including a compressor 114, a fan 115, a condenser 116, a receiver 117 and an accumulator 118, also includes a bypass system. Bypass systems are commonly used in other refrigeration equipment where multiple evaporators are connected to one compressor. The bypass system includes a liquid line solenoid valve 122 and a desuperheating thermal expansion valve 124 on bypass line 125 between the supply line 134 after the condenser 116 and the return line 136 to the compressor, and a hot gas line solenoid valve 126 and a hot gas bypass valve 128 on bypass line 129 connecting on one end between the compressor 114 and the condenser 116 and connecting on its other end to the return line 136 to the compressor 114. The bypass system is used so that the compressor does not shut off under a low pressure pump-down condition if the liquid line solenoid of each evaporator unit is closed. Otherwise, under such a condition, the compressor would cycle on and off as the suction side pressure rose and then quickly fell again. This on and off cycling would be very detrimental to the compressor.

Advantages

In its preferred embodiment, the current invention offers several improvements over prior inventions. The preferred embodiment has a separate heating unit on all evaporator units. The evaporator units may therefore enter a harvest mode without the need for a hot gas discharge from the compressor. This allows the present invention to avoid the inefficient heat loss suffered by the prior inventions as hot gas is pumped from a compressor through lengthy refrigeration lines to a remote evaporator unit.

In addition, independent heating and sensor units for each of the evaporator units allow the evaporator units to operate in both ice-making and harvest modes simultaneously. This is a further advantage realized by eliminating the need for a hot gas discharge. This will improve the overall efficiency of the ice making machine compared to prior art remote ice making machines as each evaporator unit may harvest at the optimal time, independent of the others.

Another advantage of the invention is that the remote evaporator units may be tied directly into an existing refrigeration system to utilize a pre-existing compressor. This adds flexibility and savings to the present invention.

The ice-making unit of the present invention may preferably incorporate features used in other ice-making machines, such as those disclosed in U.S. Pat. Nos. 4,480,441; 4,785,641; 5,289,691 and 5,408,834, all of which are incorporated herein by reference.

It should be appreciated that the systems and methods of the present invention are capable of being incorporated in the form of a variety of embodiments, only a few of which have been illustrated and described above. The invention may be embodied in other forms without departing from its spirit or essential characteristics. For example, rather than using an ice-forming evaporator made from dividers mounted on a plate with evaporator coils on the back as shown, other types of evaporators could be used. Also, instead of water flowing down over a vertical evaporator plate, ice could be formed by spraying water onto a horizontal ice-forming evaporator. While the electrical schematic described above is for a make-up water system, a batch water system could be used with the invention. In the preferred embodiment, the drain valve is on the pressure side of the pump. Alternatively, the drain could directly drain water from the reservoir. In addition to an electric heating unit, other types of heating units could he used, such as hot air, hot water, radiant heat, halogen heating, positive temperature coefficient semiconductor heating, microwave and induction heating.

It will be appreciated that the addition of some other process steps, materials or components not specifically included will have an adverse impact on the present invention. The best mode of the invention may therefore exclude process steps, materials or components other than those listed above for inclusion or use in the invention. However, the described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. An ice-making unit comprising:

a) a compressor unit comprising at least one compressor, at least one condenser, and interconnecting lines therefor;

b) at least two remote evaporator units each capable of entering an ice-making or a harvest mode independently of the mode of operation of the other one or more remote evaporator units, each remote evaporator unit comprising:

i) at least one ice-forming evaporator and at least one heating unit in thermal contact with said ice-forming evaporator; and (ii) at least one fresh water inlet, at least one water reservoir, at least one water circulation mechanism, and interconnecting lines therefor;

c) a supply line connecting the compressor unit to each remote evaporator unit which supplies a refrigerant from the compressor unit to each remote evaporator unit during its ice-making mode; and d) a return line connecting each remote evaporator unit to the compressor unit which returns the refrigerant from each remote evaporator unit to the compressor unit during its ice-making mode.

2. The ice-making unit of claim 1 wherein for each remote evaporator unit the ice-forming evaporator comprises an evaporator coil and an ice-forming evaporator plate in thermal contact with said evaporator coil.

3. The ice-making unit of claim 2 wherein for each remote evaporator unit the ice-forming evaporator plate comprises divided sections on a face of the ice-forming evaporator plate opposite the evaporator coil where water may be frozen into shaped ice.

4. The ice-making unit of claim 2 wherein for each remote evaporator unit the heating unit is external to the evaporator coil.

5. The ice-making unit of claim 2 wherein for each remote evaporator unit the heating unit is internal to the evaporator coil.

6. The ice-making unit of claim 5 wherein the heating unit comprises a resistive electric wire passing through the evaporator coil.

7. The ice-making unit of claim 1 wherein the supply line remains inactive for each evaporator unit while it is in its harvest mode.

8. The ice-making unit of claim 1 wherein the ice-making unit further comprises a regulatory valve for each remote evaporator unit which allows the refrigerant to circulate between the compressor unit and that remote evaporator unit during the ice-making mode and prevents the refrigerant from circulating between the compressor unit and that remote evaporator unit during the harvest mode.

9. The ice-making unit of claim 8 wherein each of said regulatory valves comprise a liquid valve.

10. The ice-making unit of claim 9 wherein each of said liquid valves comprise a liquid solenoid valve.

11. The ice-making unit of claim 1 wherein each remote evaporator unit further comprises:

a) a water distributor which distributes water from the water circulation mechanism onto the ice-forming evaporator, and b) a water drain valve for expelling water from the water reservoir.

12. The ice-making unit of claim 1 wherein for each remote evaporator unit the water circulation mechanism comprises a water pump.

13. The ice-making unit of claim 1 wherein each remote evaporator unit further comprises an ice sensor which provides a signal used to activate the heating unit when ice on the ice-forming evaporator reaches a predetermined thickness.

14. The ice-making unit of claim 1 wherein each remote evaporator unit further comprises a thermal cutoff switch which provides a signal used to deactivate the heating unit in the remote evaporator unit if the temperature of said heating unit exceeds a predetermined temperature.

15. The ice-making unit of claim 2 wherein for each remote evaporator unit the heating unit comprises an electric heating element.

16. The ice-making unit of claim 15 wherein the electric heating element comprises resistive electric heating strips.

17. The ice-making unit of claim 15 wherein the electric heating element comprises a resistive electric heating pad, said resistive electric heating pad comprising at least one electric heating coil in a thermally conductive layer covering at least a portion of the evaporator coil.

18. The ice-making unit of claim 2 wherein for each remote evaporator unit the heating unit comprises an electric tubular heater, said electric tubular heater being bent to fit between sections of the evaporator coil.

19. The ice-making unit of claim 1 further comprising a control system for controlling each remote evaporator unit.

20. The ice-making unit of claim 1 wherein each remote evaporator unit further comprises a thermal expansion valve to regulate the amount of the refrigerant entering the ice-forming evaporator.

21. An ice-making unit comprising:

a) a compressor unit comprising at least one compressor, at least one condenser, and interconnecting lines therefor;

b) a remote evaporator unit comprising:

i) at least one ice-forming evaporator and at least one heating unit in thermal contact with said ice-forming evaporator; and ii) at least one fresh water inlet, at least one water reservoir, at least one water circulation mechanism, and interconnecting lines therefor;

c) a supply line connecting the compressor unit to the remote evaporator unit which supplies a refrigerant from the compressor unit to the remote evaporator unit during an ice-making mode;

d) a return line connecting the remote evaporator unit to the compressor unit which returns the refrigerant from the remote evaporator unit to the compressor unit during said ice-making mode; and e) a regulatory valve which allows the refrigerant to circulate between the compressor unit and the remote evaporator unit during the ice-making mode and prevents the refrigerant from circulating between the compressor unit and the remote evaporator unit during a harvest mode.

22. The ice-making unit of claim 21 comprising two or more remote evaporator units connected to at least one compressor unit.

23. The ice-making unit of claim 21 wherein the regulatory valve comprises a liquid valve.

24. The ice-making unit of claim 23 wherein the liquid valve comprises a liquid solenoid valve.

25. The ice-making unit of claim 21 wherein the regulatory valve is part of the ice-forming evaporator.

26. An ice-making unit comprising:

a) a compressor unit comprising at least one compressor, at least one condenser, and interconnecting lines therefor;

b) a remote evaporator unit comprising:

i) at least one ice-forming evaporator and at least one heating unit in thermal contact with said ice-forming evaporator;

ii) at least one fresh water inlet, at least one water reservoir, at least one water circulation mechanism, and interconnecting lines therefor; and iii) a thermal cutoff switch which provides a signal used to deactivate the heating unit if the temperature of the heating unit exceeds a predetermined temperature;

c) a supply line connecting the compressor unit to the remote evaporator unit which supplies a refrigerant from the compressor unit to the remote evaporator unit during an ice-making mode; and d) a return line connecting the remote evaporator unit to the compressor unit which returns the refrigerant from the remote evaporator unit to the compressor unit during said ice-making mode.

27. The ice-making unit of claim 26 wherein for each remote evaporator unit the ice-forming evaporator comprises an evaporator coil and an ice-forming evaporator plate in thermal contact with said evaporator coil.

28. The ice-making unit of claim 26 wherein each remote evaporator unit further comprises a water distributor which distributes water from the water circulation mechanism onto the ice-forming evaporator and a water drain valve for expelling water from the water reservoir.

* * * * *

UNITED STATES PATENT AND TRADEMARK OFFICE

CERTIFICATE OF CORRECTION

PATENT NO. : 5,787,723

DATED : August 4, 1998

INVENTOR(S) : Lee G. Mueller et al.

It is certified that error appears in the above-identified patent and that said Letters Patent is hereby corrected as shown below:

On the Title Page

In column 1, item [75], line 6, please change "Manitow," to --Manitowoc,--.

In claim 21, paragraph ii) should be indented (see paragraph i)).

Signed and Sealed this

Tenth Day of April, 2001

*Attest:*

Nicholas P. Godici

NICHOLAS P. GODICI

*Attesting Officer*

*Acting Director of the United States Patent and Trademark Office*